US006731262B2

(12) United States Patent
Hector et al.

(10) Patent No.: US 6,731,262 B2
(45) Date of Patent: May 4, 2004

(54) ACTIVE MATRIX DISPLAY DEVICE

(75) Inventors: Jason R. Hector, Redhill (GB); Neil C. Bird, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 145 days.

(21) Appl. No.: 10/071,402

(22) Filed: Feb. 8, 2002

(65) Prior Publication Data

US 2002/0122032 A1 Sep. 5, 2002

(30) Foreign Application Priority Data

Mar. 2, 2001 (GB) ..... 0105147

(51) Int. Cl.[7] ..... G09G 3/36
(52) U.S. Cl. ..... 345/98; 345/671
(58) Field of Search ..... 345/92, 98, 99, 345/100, 671, 674

(56) References Cited

U.S. PATENT DOCUMENTS 5,130,829 A 7/1992 Shannon ..... 359/59
5,448,259 A * 9/1995 Hidaka ..... 345/99
6,088,014 A * 7/2000 Furuhashi et al. ..... 345/671
6,310,628 B1 * 10/2001 Matsushita et al. ..... 345/684
6,373,459 B1 * 4/2002 Jeong ..... 345/100

FOREIGN PATENT DOCUMENTS

EP 0737957 A1 4/1996 ..... G09G/3/36
EP 0789345 A1 8/1996 ..... G09G/3/36
WO WO9952012 10/1999 ..... G02F/1/136

* cited by examiner

*Primary Examiner*—Richard Hjerpe
*Assistant Examiner*—Kevin Nguyen

(57) ABSTRACT

A display uses column address circuitry having a plurality of multiplexing switching arrangements (50), each of which is associated with two buffers (46*a*;46*b*) for providing selected pixel drive signals. The two buffers provide respective pixel drive signals simultaneously to two adjacent columns, such that the pixel drive signal for one column starts before the end of the pixel drive signal for the column driven previously, and ends after the end of the pixel drive signal for the column driven previously. This enables a reduction in the number of buffers required and reduces the cross talk between column signals for adjacent columns within the group of columns shared by each multiplexing arrangement. This is achieved by ensuring that any capacitive coupling between first and second columns is charged to a static level before the signal on one of the columns is switched off.

10 Claims, 7 Drawing Sheets

| | Mux Block x | Mux Block x+1 | | | | | | | | | |
|---|---|---|---|---|---|---|---|---|---|---|---|
| | C9 | C0 | C1 | C2 | C3 | C4 | C5 | C6 | C7 | C8 | C9 |
| T0 | V9 | V0 | z | z | z | z | z | z | z | z | z |
| T1 | | V0 | V1 | z | z | z | z | z | z | z | z |
| T2 | | z | V1 | V2 | z | z | z | z | z | z | z |
| T3 | | z | z | V2 | V3 | z | z | z | z | z | z |
| T4 | | z | z | z | V3 | V4 | z | z | z | z | z |
| T5 | | z | z | z | z | V4 | V5 | z | z | z | z |
| T6 | | z | z | z | z | z | V5 | V6 | z | z | z |
| T7 | | z | z | z | z | z | z | V6 | V7 | z | z |
| T8 | | z | z | z | z | z | z | z | V7 | V8 | z |
| T9 | | z | z | z | z | z | z | z | z | V8 | V9 |

t

ACTIVE MATRIX DISPLAY DEVICE

This invention relates to active matrix display devices, and relates in particular to the circuitry used for providing drive signals to the pixels of the display.

Active matrix display devices typically comprise an array of pixels arranged in rows and columns. Each row of pixels shares a row conductor which connects to the gates of the thin film transistors of the pixels in the row. Each column of pixels shares a column conductor, to which pixel drive signals are provided. The signal on the row conductor determines whether the transistor is turned on or off, and when the transistor is turned on, by a high voltage pulse on the row conductor, a signal from the column conductor is allowed to pass on to an area of liquid crystal material, thereby altering the light transmission characteristics of the material. An additional storage capacitor may be provided as part of the pixel configuration to enable a voltage to be maintained on the liquid crystal material even after removal of the row electrode pulse. U.S. Pat. No. 5,130,829 discloses in more detail the design of an active matrix display device.

The frame (field) period for active matrix display devices requires a row of pixels to be addressed in a short period of time, and this in turn imposes a requirement on the current driving capabilities of the transistor in order to charge or discharge the liquid crystal material to the desired voltage level. In order to meet these current requirements, the gate voltage supplied to the thin film transistor needs to fluctuate between values separated by approximately 30 volts. For example, the transistor may be turned off by applying a gate voltage of around −10 volts, or even lower, (with respect to the source) whereas a voltage of around 20 volts, or even higher, may be required to bias the transistor sufficiently to provide the required source-drain current to charge or discharge the liquid crystal material sufficiently rapidly.

The requirement for large voltage swings in the row conductors requires the row driver circuitry to be implemented using high voltage components.

The voltages provided on the column conductors typically vary by approximately 10 volts, which represents the difference between the drive signals required to drive the liquid crystal material between white and black states. Various drive schemes have been proposed enabling the voltage swing on the column conductors to be reduced, so that lower voltage components may be used in the column driver circuitry. In the so-called "common electrode drive scheme", the common electrode, connected to the full liquid crystal material layer, is driven to an oscillating voltage. The so-called "four-level drive scheme" uses more complicated row electrode waveforms in order to reduce the voltage swing on the column conductors, using capacitive coupling effects.

These drive schemes enable lower voltage components to be used for the column driver circuitry. However, there is still a significant amount of complexity and power inefficiency in the column driver circuits. Each row is addressed in turn, and during the row address period of any one row, pixel signals are provided to each column. In the past, each column would be provided with a buffer for holding a pixel in the column to a drive signal level for the full duration of the row address period. This large number of buffers results in high power consumption.

There have been proposals to provide a multiplexing scheme, in which a buffer is shared between a group of columns. The output of the buffer is switched in turn to the columns of the group. When the buffer is providing a signal to one column, it is isolated from the other columns by a switch. Multiplexing is possible because the line time of the display is significantly greater than the time required to charge a column to the required voltage. In small displays for mobile applications, the line time may be in excess of 150 $\mu$s whereas the time required to charge a column is typically less than 10 $\mu$s.

Once the column has been charged to the required voltage, and after the end of the application of the required voltage to the column, charge transfer takes place between the charged column capacitance and the pixel capacitance. The column capacitance may be around 30 times larger than the column capacitance, so that the charge transfer to the pixel results in only a small voltage change. However, this charge transfer enables the pixel to be charged using a short column address pulse, despite the longer time constant of the pixel (resulting from the high TFT resistance).

A problem with this multiplexing approach is that there is cross talk between the columns within the group, particularly as all but one of the columns of the group are effectively floating at any point in time, and are therefore susceptible to signal level fluctuations. During the row address period, the TFTs of all pixels in the row are switched on (and indeed this enables the charge transfer to take place between the column capacitance and the pixel), so that any signal fluctuations on the column conductors as a result of cross talk are passed onto the pixels.

According to a first aspect of the invention, there is provided a display device comprising an array of liquid crystal pixels arranged in rows and columns, wherein each column of pixels shares a column conductor to which pixel drive signals are provided, wherein column address circuitry is provided for generating the pixel drive signals, the column address circuitry comprising a plurality of multiplexing switching arrangements, each for providing drive signals to a plurality of columns in turn, wherein each multiplexing switching arrangement is associated with two buffers for providing selected pixel drive signals, wherein the two buffers provide respective pixel drive signals simultaneously to two adjacent columns, such that the pixel drive signal for one column starts before the end of the pixel drive signal for the column driven previously, and ends after the end of the pixel drive signal for the column driven previously.

The invention provides a multiplexing scheme which enables a reduction in the number of buffers required but which reduces the cross talk between column signals for adjacent columns within the group of columns shared by each multiplexing arrangement. This is achieved by ensuring that any capacitive coupling between first and second columns is charged to a static level before the signal on one of the columns is switched off. Thus, one column is only switched off after the next column has been addressed, so that any capacitive coupling between one column and the next is charged to a static level, and the signal on the next column no longer has any influence on the previous column.

Preferably, the apparatus further comprises circuitry for generating all possible pixel drive signals and a switching matrix for switching selected drive signals to the two buffers of each multiplexing switching arrangement. The switching matrix may receive digital image data and analogue pixel drive signals, and select the appropriate analogue pixel drive signal for each buffer based on the digital image data.

Each column may be provided with pixel drive signals twice within each row address period. This allows charge redistribution with the various capacitive elements of the columns after the first set of pixel drive signals, and then enables the second set of pixel drive signals to provide more accurate pixel control.

Each pixel preferably comprises a thin film transistor switching device and a liquid crystal cell, wherein each row of pixels share a row conductor which connects to the gates of the thin film transistors of the pixels in the row, and wherein row driver circuitry provides row address signals for controlling the switching of the transistors of the pixels of the row.

According to a second aspect of the invention, there is provided a method of providing pixel drive signals to a display device comprising an array of liquid crystal pixels arranged in rows and columns, the columns being divided into groups, each group sharing a multiplexing switching arrangement and two buffers for providing selected pixel drive signals, the method comprising, for each group of columns, applying pixel drive signals to all columns in the group in a cyclical manner, wherein the one column is provided with a pixel drive signal by one buffer before the pixel drive signal for the preceding column in the cycle, provided by the other buffer, is finished.

This method implements the drive scheme discussed above. At the end of the pixel drive signal to one column from each buffer, that buffer is used to apply a pixel drive signal to a column two ahead of the one column in the cycle. This results in a continuous cycle.

One multiplexing arrangement may address the columns of the respective group in a first order, and an adjacent multiplexing arrangement may address the columns of the respective group in a second order, such that columns in one group adjacent columns in the other group are addressed at substantially the same time. This smoothes errors across the display dependent on the specific timing of the address signals for different columns.

The invention also provides column address circuitry for driving the columns of a liquid crystal display, comprising a plurality of multiplexing switching arrangements, each for providing drive signals to a plurality of columns in turn, wherein each multiplexing switching arrangement is associated with two buffers for providing selected pixel drive signals, wherein the two buffers provide respective pixel drive signals simultaneously to two adjacent columns, such that the pixel drive signal for one column starts before the end of the pixel drive signal for the column driven previously, and ends after the end of the pixel drive signal for the column driven previously.

Examples of the invention will now be described in detail with reference to the accompanying drawings, in which.

Figure 1:
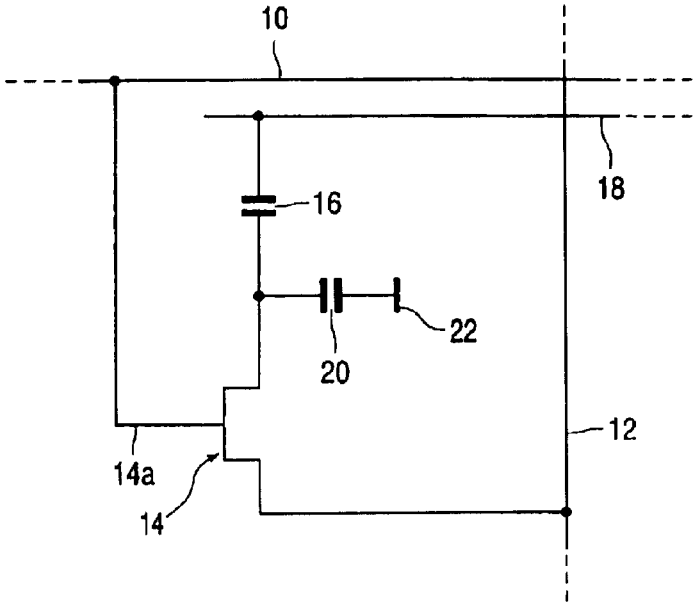
FIG. 1 shows one example of a known pixel configuration for an active matrix liquid crystal display.

FIG. 1 shows a conventional pixel configuration for an active matrix liquid crystal display. The display is arranged as an array of pixels in rows and columns. Each row of pixels shares a common row conductor 10, and each column of pixels shares a common column conductor 12. Each pixel comprises a thin film transistor 14 and a liquid crystal cell 16 arranged in series between the column conductor 12 and a common potential 18. The transistor 14 is switched on and off by a signal provided on the row conductor 10. The row conductor 10 is thus connected to the gate 14*a* of each transistor 14 of the associated row of pixels. Each pixel may additionally comprise a storage capacitor 20 which is connected at one end 22 to the next row electrode, to the preceding row electrode, or to a separate capacitor electrode. This capacitor 20 helps to maintain the drive voltage across the liquid crystal cell 16 after the transistor 14 has been turned off. A higher total pixel capacitance is also desirable to reduce various effects, such as kickback, and to reduce the grey-level dependence of the pixel capacitance.

In order to drive the liquid crystal cell 16 to a desired voltage to obtain a required grey level, an appropriate signal is provided on the column conductor 12 in synchronism with a row address pulse on the row conductor 10. This row address pulse turns on the thin film transistor 14, thereby allowing the column conductor 12 to charge the liquid crystal cell 16 to the desired voltage, and also to charge the storage capacitor 20 to the same voltage.

Figure 2:
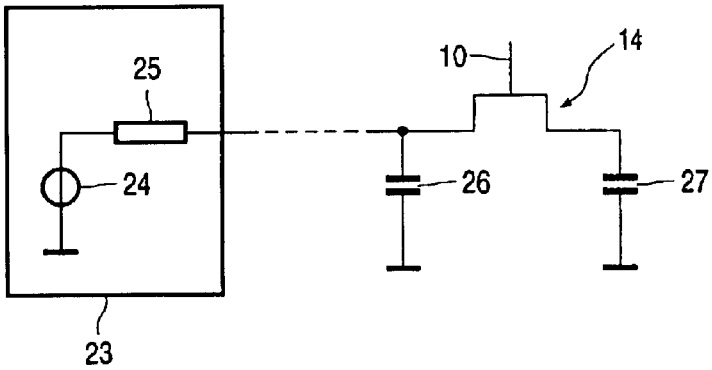
FIG. 2 is used to explain charge flow during pixel charging.

FIG. 2 shows the connection between the column driver 23 (which essentially comprises a voltage source 24 and a switch having resistance 25) and the pixel of the column in the selected row. The column has a column capacitance 26, which results, for example, from all of the cross overs of the column with the row conductors. The individual pixel has a pixel capacitance 27. The column drive signal results in charging of both capacitances 26 and 27. However the time constant for charging the column capacitor 26 (resistance 25×capacitance 26) is much lower than the time constant for charging the pixel (TFT resistance×capacitance 27). Thus, a short column address pulse is required to charge the column capacitance 26.

After the column address pulse, but while the row address pulse is still active, there is charge transfer between the capacitance 26 and the capacitance 27, until an equilibrium is reached. The pixel capacitance is much smaller than the column capacitance, so that the equilibrium is reached with little change in the column voltage. The large time constant of the pixel results from the high TFT resistance. The charge transfer enables a shorter column address pulse to be used than is required to charge the pixel to the required voltage. However, as will be explained below, two short column address pulses may be used, so that the error due to charge transfer is reduced.

At the end of the row address pulse, the transistor 14 is turned off. The storage capacitor 20 reduces the effect of liquid crystal leakage and reduces the percentage variation in the pixel capacitance caused by the voltage dependency of the liquid crystal cell capacitance. The rows are addressed sequentially so that all rows are addressed in one frame period, and refreshed in subsequent frame periods.

Figure 3:
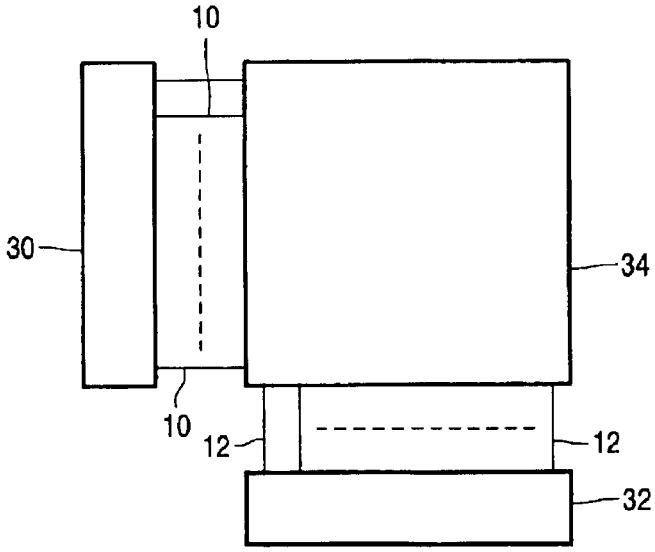
FIG. 3 shows a display device including row and column driver circuitry.

As shown in FIG. 3, the row address signals are provided by row driver circuitry 30, and the pixel drive signals are provided by column address circuitry 32, to the array 34 of display pixels.

In order to enable a sufficient current to be driven through the thin film transistor 14, which is implemented as an amorphous silicon thin film device, a high gate voltage must be used. In particular, the period during which the transistor is turned on is approximately equal to the total frame period within which the display must be refreshed, divided by the number of rows. It is well known that the gate voltage for the on-state and the off-state differ by approximately 30 volts in order to provide the required small leakage current in the off-state, and sufficient current flow in the on-state to charge or discharge the liquid crystal cell 16 within the available time. As a result, the row driver circuitry 30 uses high voltage components.

There are various known addressing schemes for driving the display of FIG. 1, particularly concerning the row pulse waveforms and the voltage to which the common LC plate is drive. These will not be described in detail in this text. Some of the known operational techniques are described in greater detail, for example, in U.S. Pat. No. 5,130,829 and WO 99/52012, and these documents are incorporated herein by way of reference material. The invention can be adapted to many drive schemes.

Figure 4:
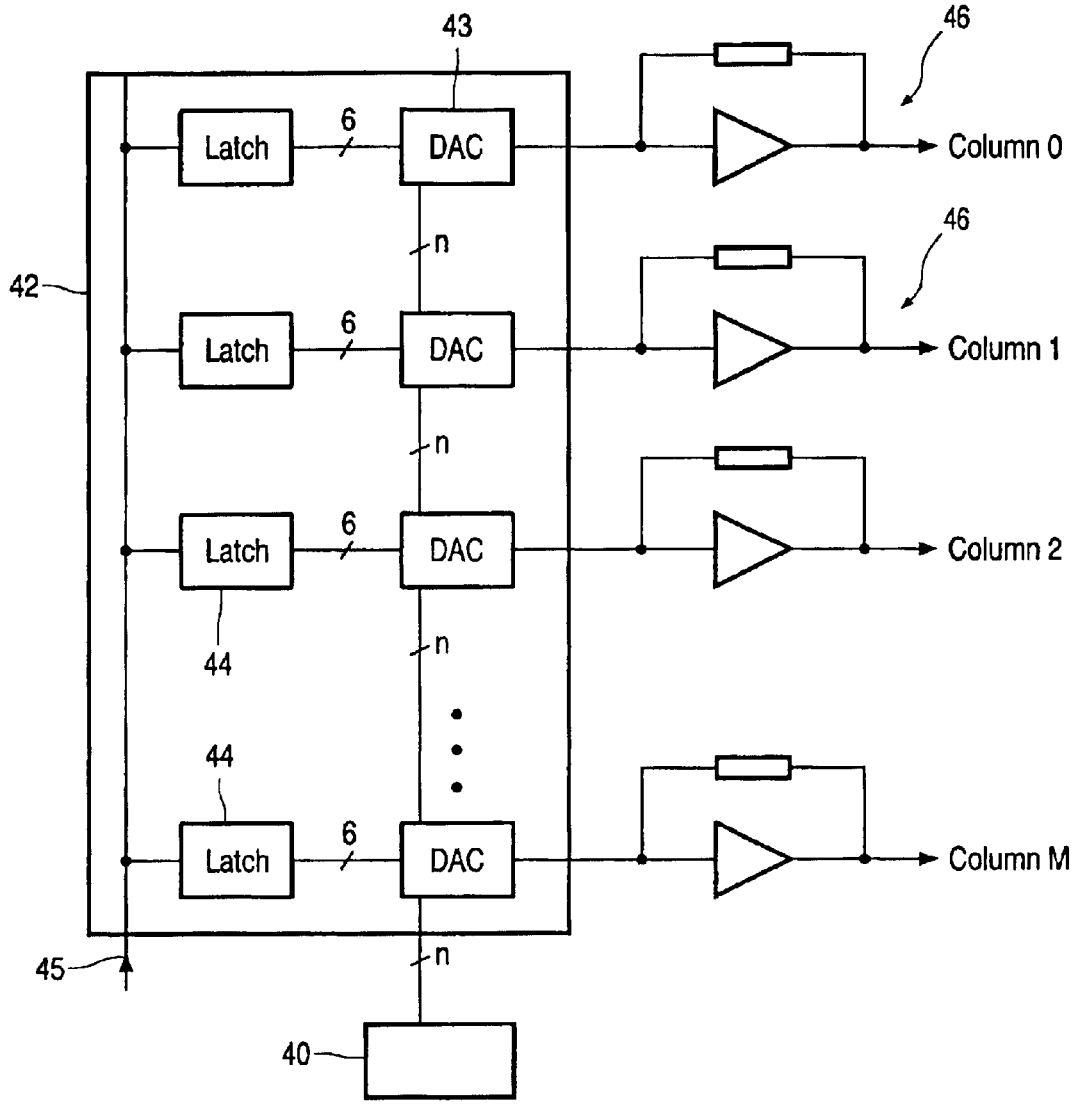
FIG. 4 shows a conventional column driver circuit.

FIG. 4 shows a conventional column driver circuit. The number n of different pixel drive signal levels are generated by a grey level generator 40, for example a resistor array. A switching matrix 42 controls the switching of the required level to each column and comprises an array of converters 43 for selecting one of the n grey levels based on a digital input from a latch 44. The digital input is derived from a RAM storing the required image data 45. Each column is provided with a buffer 46 for holding a pixel in the column to the required drive signal level for the full duration of the row address period. This large number of buffers 46 results in high power consumption.

Figures 5, 6:
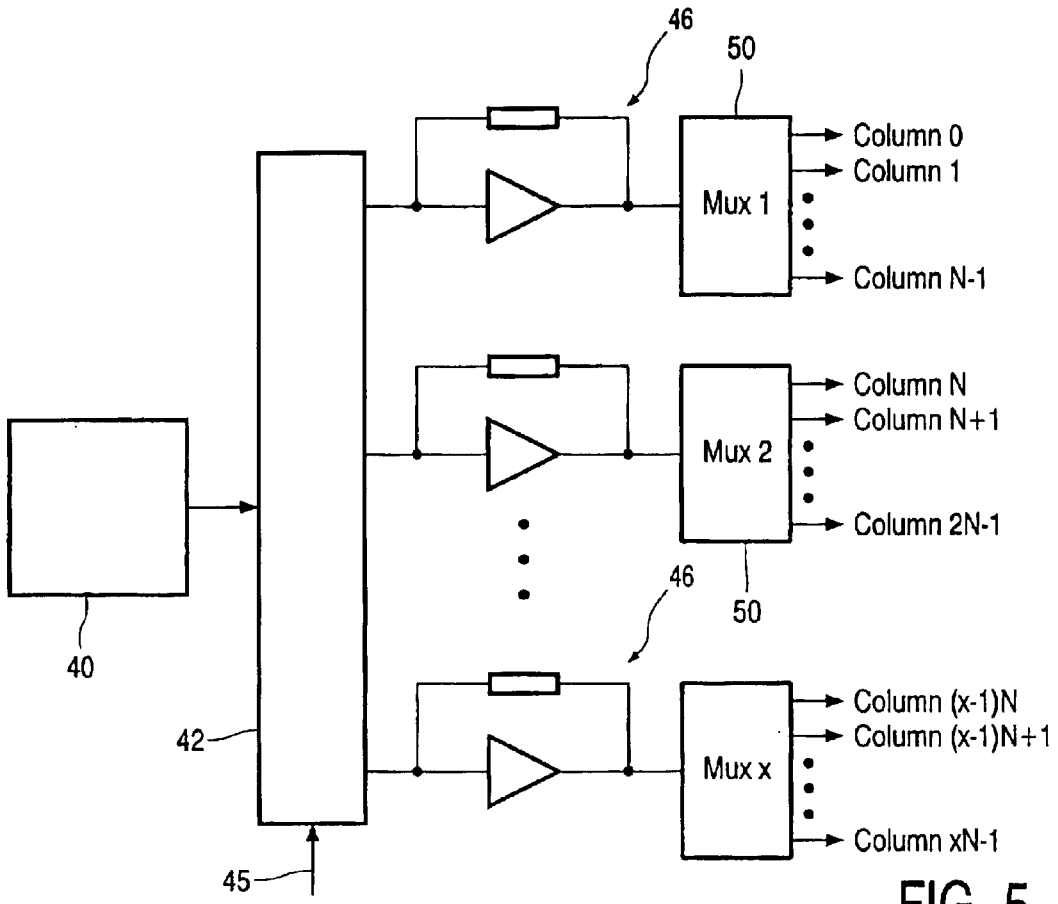
FIG. 5 shows one possible column driver circuit using with multiplexing to reduce the number of buffers
FIG. 6 is used to explain a column drive scheme of the invention.

To reduce power in a low power chipset to drive the active matrix LCD, the total number of buffers needs to be reduced. FIG. 5 shows a multiplexing scheme, in which a buffer 46 is shared between a group of N columns. The output of the buffer is switched in turn to the columns of the group using a multiplexing switch 50. When the buffer is providing a signal to one column, it is isolated from the other columns by the switch. The cross talk between the columns within the group is a problem, particularly the influence of one column on an adjacent column which has just been addressed (i.e. the previous column in the address cycle).

This cross talk results from the capacitances between adjacent columns, which is caused by the physical pixel structure, for example the overlap of the pixel pad on the column electrode or the proximity of the pixel to the column electrode.

FIG. 6 is used to explain the driving scheme for an arbitrary multiplexing ratio of 10. Each row of the table represents the signals applied to the different columns C0, C1, . . . , C9 at a particular instant in time T0, T1, . . . , T9. The table shows that at any point in time T, pixel drive signals are provided to two (adjacent) columns C. The pixel drive signal for one column Cn starts before the end of the pixel drive signal for the column driven previously C(n−1), and ends after the end of the pixel drive signal for the column driven previously. Ten such rows are in the table, and the table therefore shows the driving of all ten columns in a cycle. As will be described below, two such cycles may be used during each row address period.

A "z" indicates that the corresponding multiplexer switch is turned off (high impedance (z) state), so that the column is not being driven. Voltage Vx is applied to column x.

Considering the voltages applied to column C1, during time slot T1, a voltage V1 is applied to the column and the pixel starts charging to V1. At the end of this timeslot, of 10 μs for example, voltage V2 is applied to column C2. However, the V1 voltage is maintained on column C1 to prevent any capacitive coupling from the transition to column C2. In general, this prevents capacitive coupling from column x to column x−1.

At the start of column signal V1 (at time slot T1), there is some capacitive coupling of column C1 with column C2 which is then in the high impedance state. However, the effects of this are very quickly overridden as column C2 is next to be addressed.

Figure 7:
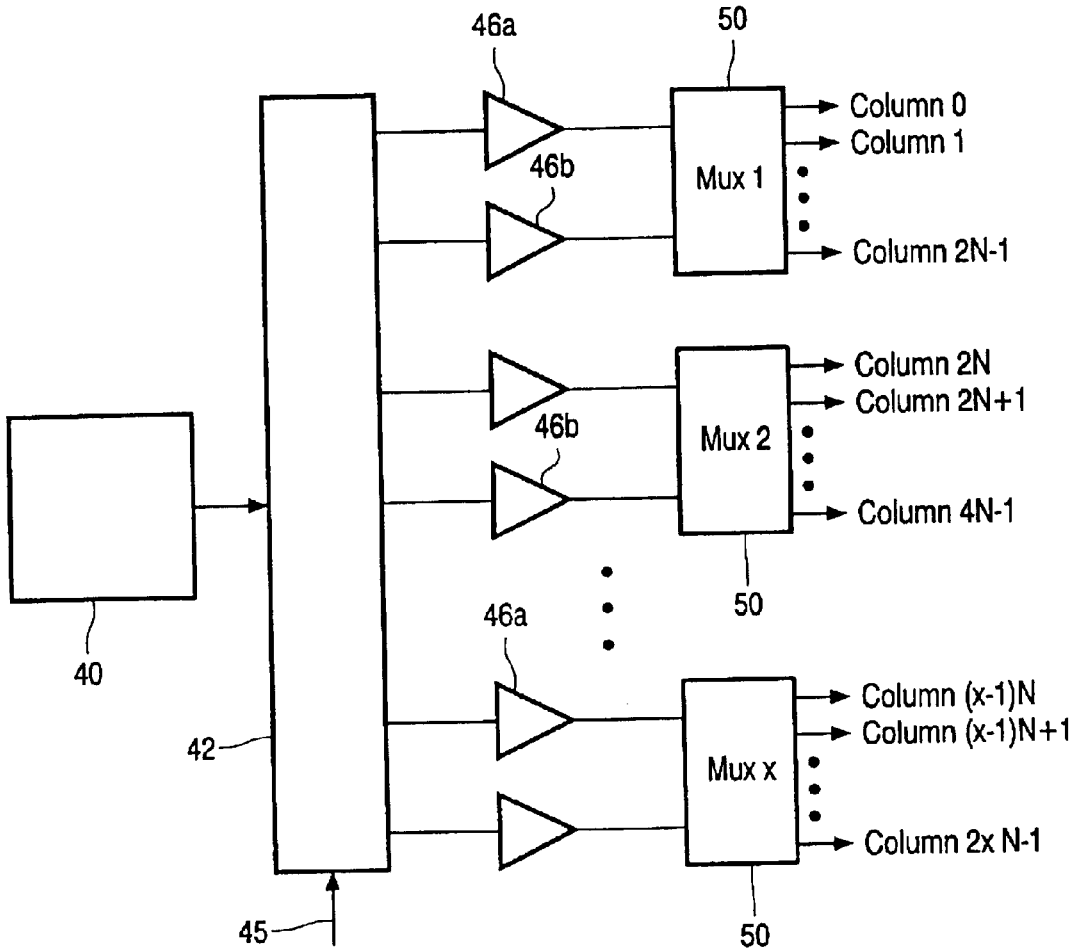
FIG. 7 shows a column driver circuit of the invention.

As this scheme requires two outputs to be active at any time, modified hardware is required. FIG. 7 shows the column address circuitry which has a plurality of multiplexing switching arrangements 50 with each multiplexing switching arrangement 50 associated with two buffers 46*a* and 46*b*. The two buffers 46*a* and 46*b* provide respective pixel drive signals simultaneously to two adjacent columns.

Figure 8:
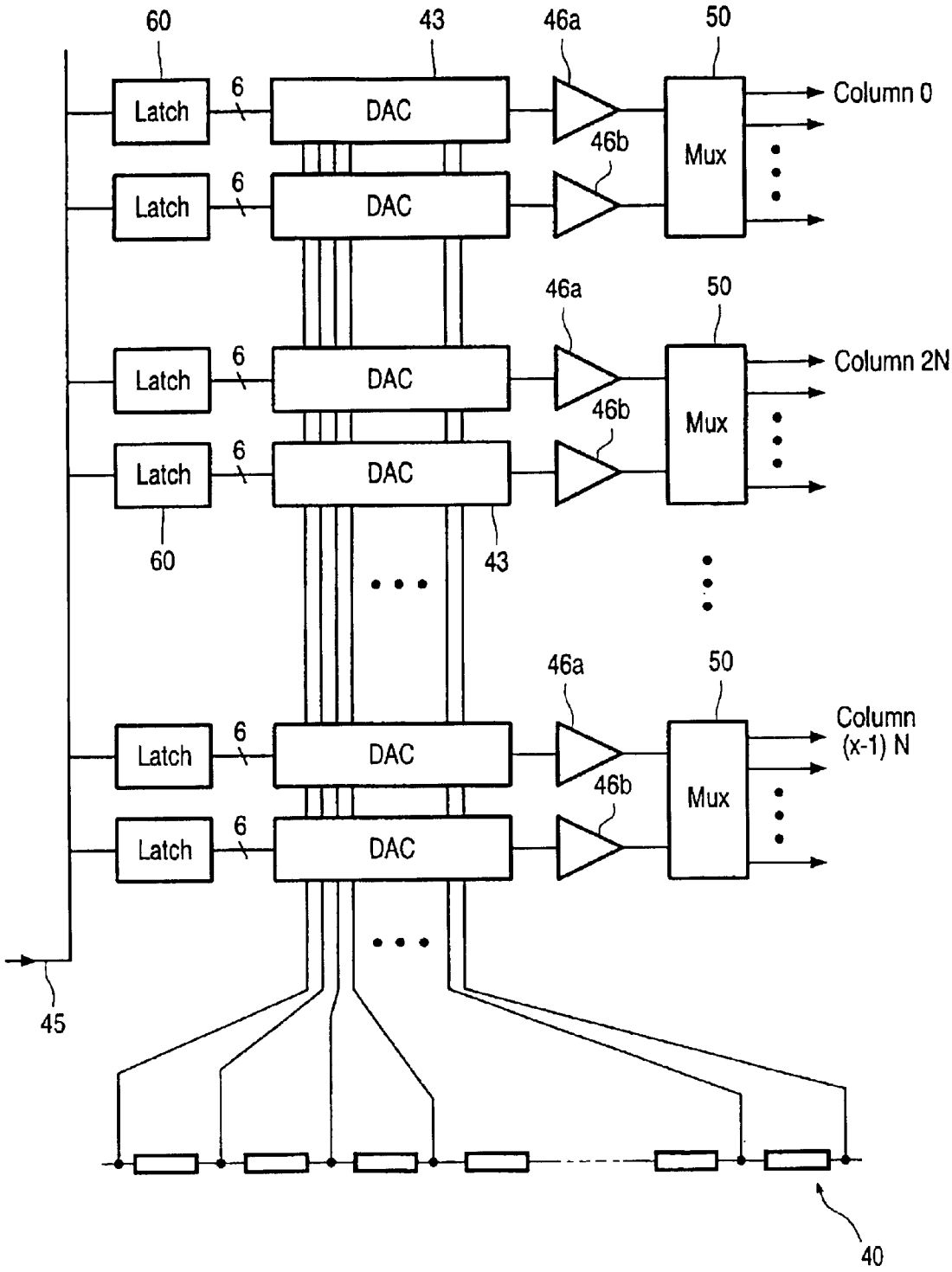
FIG. 8 shows a column driver circuit of the invention in more detail.

FIG. 8 shows an implementation of the circuit of FIG. 7 with an R-DAC used to choose the voltage level for each buffer. A digital signal 45 representing the required pixel drive level is latched by latches 60 to the Resistor-DAC circuits 43, which converts the latched signal into one of the analogue grey levels from the grey level generation circuit 40. These analogue signals are then provided to the buffers 46*a* and 46*b*.

To reduce further the power consumption and to remove the potential for incorrect voltages to be stored on the pixel, each column may be provided with pixel drive signals twice within each row address period. This allows charge redistribution with the various capacitive elements of the columns after the first set of pixel drive signals, and then enables the second set of pixel drive signals to provide more accurate pixel control. The column parasitic capacitances are charged up in the initial phase, and the charge is then allowed to redistribute to the pixel. When charge leaves the pixel, the column voltage will drop, and the second addressing phase recharges the parasitic capacitances by applying the desired column voltage once again.

As explained with reference to FIG. 6, each column under the control of a particular multiplexer is addressed before the signal on the preceding column is terminated. In addition, the last columns to be addressed by one multiplexer can be arranged to be adjacent the last columns to be arranged by an adjacent multiplexer. This is explained with reference to FIG. 9.

Figure 9:
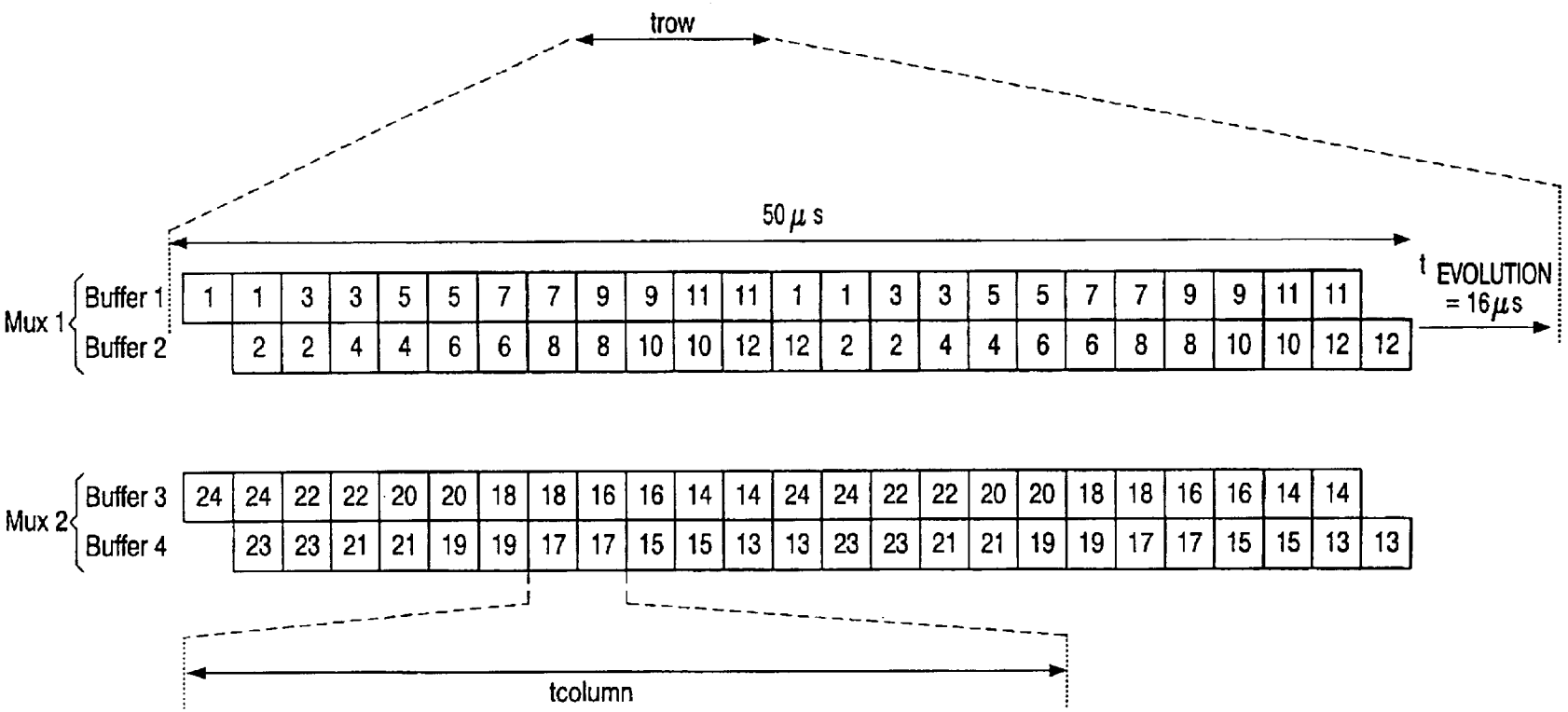
FIG. 9 shows how adjacent multiplexers are driven.

By way of example only, FIG. 9 assumes that each multiplexer provides signals to 12 columns, using two buffers. During the row address period $t_{ROW}$, each multiplexer (for example Mux 1 and Mux 2) address the respective 12 columns twice. Each number in the rows of numbers of FIG. 9 represents the column to which a column drive signal is provided at that point in time. In the example shown, Mux 1 addresses columns 1 to 12 in order, using the two buffers. At the end of the column address signals, there is a so-called evolution period $t_{EVOLUTION}$. As explained above, after the column drive signal, charge transfer takes place between the charged column capacitance and the pixel capacitance. Thus, pixel charging continues after the end of the column drive signal. The evolution period is required to enable charge transfer for pixels in the last addressed columns.

By way of example, 60 Hz gives a frame period of 16.7 ms. Assuming 241 columns, the row period is 69 microseconds. This can be made up of 50 microseconds of column drive pulses and 16 microseconds of evolution period, as shown, with 3 microsecond guard band between row pulses. Each column pulse $t_{COLUMN}$ is around 4 microseconds long.

Because the charge transfer time is shorter for the columns addressed last (for example columns 11 and 12 for Mux 1), there may be larger errors in these columns. It is advantageous for errors to vary smoothly across the device rather than abruptly. For this reason, the last addressed columns of one multiplexer block are placed adjacent the last addressed columns of an adjacent multiplexer block.

Thus, Mux 2 addresses columns 12 to 24 in reverse order, so that columns 13 and 14 are addressed last. These are adjacent to columns 11 and 12 so that there is a gradual variation in errors across the display.

Figure 10:
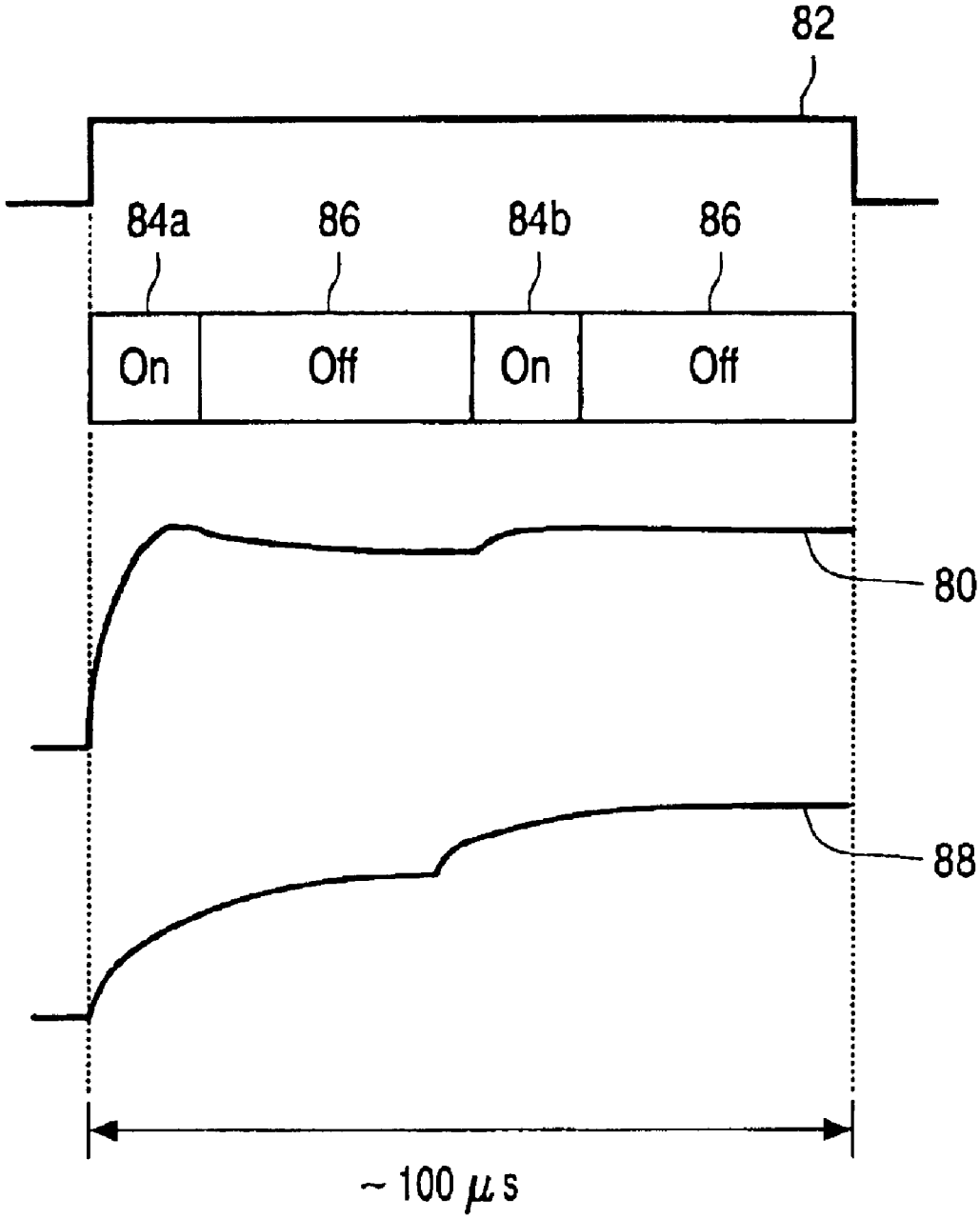
FIG. 10 shows pixel charging in a two-phase column address scheme of the invention.

FIG. 10 shows the how the column voltage 80 varies as the column is addressed twice within a row address period 82. The column driver is ON at times 84 and OFF at times 86. The pixel voltage 88 does not need to be fully charged in the first time period 84*a*. This is important as the time constant of the TFT and pixel is much greater than the time constant of the multiplexer switches and column capacitance. Charge redistribution takes place after the first addressing phase 84*a*, (hence the drop in voltage 80 after the first ON period) and if any errors appear on the pixel whilst the other columns are being addressed, this is corrected by the second addressing phase 84*b*. The pixel is charged reliably despite the short addressing period relative to the line time.

Although the architecture of the invention requires two buffers for each multiplexer block, the multiplex ratio can be doubled, because of the overlap of the column address signals. Thus, if each column address signal lasts 10 $\mu$s, one column can be addressed on average every 5 $\mu$s, enabling double the number of columns to be addressed within the row address period. Thus, in comparison with the multiplexing scheme of FIG. 4, the same reduction in the number of buffers is achieved, and half the number of multiplexing switches is required.

The terms "row" and "column" are somewhat arbitrary in the description and claims. These terms are intended to clarify that there is an array of elements with orthogonal lines of elements sharing common connections. Although a row is normally considered to run from side to side of a display and a column to run from top to bottom, the use of these terms is not intended to be limiting in this respect.

The column circuit may be implemented as an integrated circuit, and the invention also relates to the column circuits for implementing the display architecture described above.

Other features of the invention will be apparent to those skilled in the art.

What is claimed is:

1. A display device comprising an array of liquid crystal pixels arranged in rows and columns, wherein each column of pixels shares a column conductor to which pixel drive signals are provided, wherein column address circuitry is provided for generating the pixel drive signals, the column address circuitry comprising a plurality of multiplexing switching arrangements, each for providing drive signals to a plurality of columns in turn, wherein each multiplexing switching arrangement is associated with two buffers for providing selected pixel drive signals, wherein the two buffers provide respective pixel drive signals simultaneously to two adjacent columns, such that the pixel drive signal for one column starts before the end of the pixel drive signal for the column driven previously, and ends after the end of the pixel drive signal for the column driven previously.

2. A display device as claimed in claim 1, further comprising circuitry for generating all possible pixel drive signals and a switching matrix for switching selected drive signals to the two buffers of each multiplexing switching arrangement.

3. A display device as claimed in claim 2, wherein the switching matrix receives digital image data and analogue pixel drive signals, and selects the appropriate analogue pixel drive signal for each buffer based on the digital image data.

4. A display device as claimed in claim 1, wherein each column is provided with pixel drive signals twice within each row address period.

5. A display device as claimed in claim 1, wherein each pixel comprises a thin film transistor switching device and a liquid crystal cell, wherein each row of pixels share a row conductor which connects to the gates of the thin film transistors of the pixels in the row, and wherein row driver circuitry provides row address signals for controlling the switching of the transistors of the pixels of the row.

6. A method of providing pixel drive signals to a display device comprising an array of liquid crystal pixels arranged in rows and columns, the columns being divided into groups, each group sharing a multiplexing switching arrangement and two buffers for providing selected pixel drive signals, the method comprising, for each group of columns, applying pixel drive signals to all columns in the group in a cyclical manner, wherein one column is provided with a pixel drive signal by one buffer before the pixel drive signal for the preceding column in the cycle, provided by the other buffer, is finished.

7. A method as claimed in claim 6, wherein at the end of the pixel drive signal to one column from each buffer, that buffer is used to apply a pixel drive signal to a column two ahead of the one column in the cycle.

8. A method as claimed in claim 6, wherein each column is provided with pixel drive signals twice within each row address period.

9. A method as claimed in claim 6, wherein one multiplexing arrangement addresses the columns of the respective group in a first order, and an adjacent multiplexing arrangement addresses the columns of the respective group in a second order, such that columns in one group adjacent columns in the other group are addressed at substantially the same time.

10. Column address circuitry for driving the columns of a liquid crystal display, comprising a plurality of multiplexing switching arrangements, each for providing drive signals to a plurality of columns in turn, wherein each multiplexing switching arrangement is associated with two buffers for providing selected pixel drive signals, wherein the two buffers provide respective pixel drive signals simultaneously to two adjacent columns, such that the pixel drive signal for one column starts before the end of the pixel drive signal for the column driven previously, and ends after the end of the pixel drive signal for the column driven previously.

* * * * *